US011823610B2

(12) United States Patent
Hatakenaka et al.

(10) Patent No.: US 11,823,610 B2
(45) Date of Patent: Nov. 21, 2023

(54) INPUT SIGNAL CORRECTION DEVICE

(71) Applicant: IIX INC., Tokyo (JP)

(72) Inventors: Makoto Hatakenaka, Tokyo (JP); Takashi Sakamoto, Tokyo (JP); Yoshihide Minegishi, Tokyo (JP); Ryohei Hatta, Tokyo (JP); Norimasa Senda, Tokyo (JP)

(73) Assignee: IIX INC., Tokyo (JP)

( * ) Notice: Subject to any disclaimer, the term of this patent is extended or adjusted under 35 U.S.C. 154(b) by 0 days.

(21) Appl. No.: 17/912,985

(22) PCT Filed: Feb. 25, 2021

(86) PCT No.: PCT/JP2021/007040
§ 371 (c)(1),
(2) Date: Sep. 20, 2022

(87) PCT Pub. No.: WO2021/192797
PCT Pub. Date: Sep. 30, 2021

(65) Prior Publication Data

US 2023/0162648 A1 May 25, 2023

(30) Foreign Application Priority Data

Mar. 24, 2020 (JP) ..... 2020-052410
Sep. 28, 2020 (JP) ..... 2020-162200

(51) Int. Cl.
*G09G 3/20* (2006.01)

(52) U.S. Cl.
CPC ... *G09G 3/2074* (2013.01); *G09G 2300/0452* (2013.01); *G09G 2310/08* (2013.01); *G09G 2330/021* (2013.01)

(58) Field of Classification Search
CPC ..... G09G 3/2074; G09G 2300/0452; G09G 2310/08; G09G 2330/021; G09G 3/20;
(Continued)

(56) References Cited

U.S. PATENT DOCUMENTS

2006/0092329 A1* 5/2006 Noji ..... H04N 9/31 348/E9.053
2007/0252782 A1* 11/2007 Yui ..... G09G 3/2092 345/58
2013/0257915 A1 10/2013 Yang et al.

FOREIGN PATENT DOCUMENTS

JP 2007-094338 A 4/2007
JP 2007-199683 A 8/2007
(Continued)

OTHER PUBLICATIONS

Apr. 20, 2021 International Search Report issued in Patent Application No. PCT/JP2021/007040.
(Continued)

*Primary Examiner* — Adam R. Giesy
(74) *Attorney, Agent, or Firm* — Oliff PLC

(57) ABSTRACT

An input signal correction device includes an input circuit, extension circuit, degenerate circuit, separation circuit, recovery circuit and delay adjustment circuit that operate at an operating frequency f, demura circuit that operates at an operating frequency f/2, and adder circuit. The extension circuit extends the period of R and B input signals by a factor of 2 and outputs preprocessing signals, the degenerate circuit degenerates a G input signal, the demura circuit corrects preprocessing signals from the extension and degenerate circuits and outputs correction signals, the separation circuit reduces the period of the R and B correction signals to ½ and outputs differential signals, recovery circuit reduces the period of G correction signal to ½ and outputs the same differential signal over two periods, the delay adjustment circuit delays the input and output signals, and the adder circuit adds the differential signals to the delay signals and outputs output signals.

8 Claims, 7 Drawing Sheets

(58) Field of Classification Search
CPC ..... G09G 3/3233; G09G 5/00; G09G 5/36; G09G 5/391
See application file for complete search history.

(56) References Cited

FOREIGN PATENT DOCUMENTS

| | | | |
|---|---|---|---|
| JP | 4647213 | B2 | 3/2011 |
| JP | 6220674 | B2 | 10/2017 |
| WO | 2018/016745 | A1 | 1/2018 |

OTHER PUBLICATIONS

Apr. 20, 2021 Written Opinion of the International Searching Authority issued in Patent Application No. PCT/JP2021/007040.

* cited by examiner

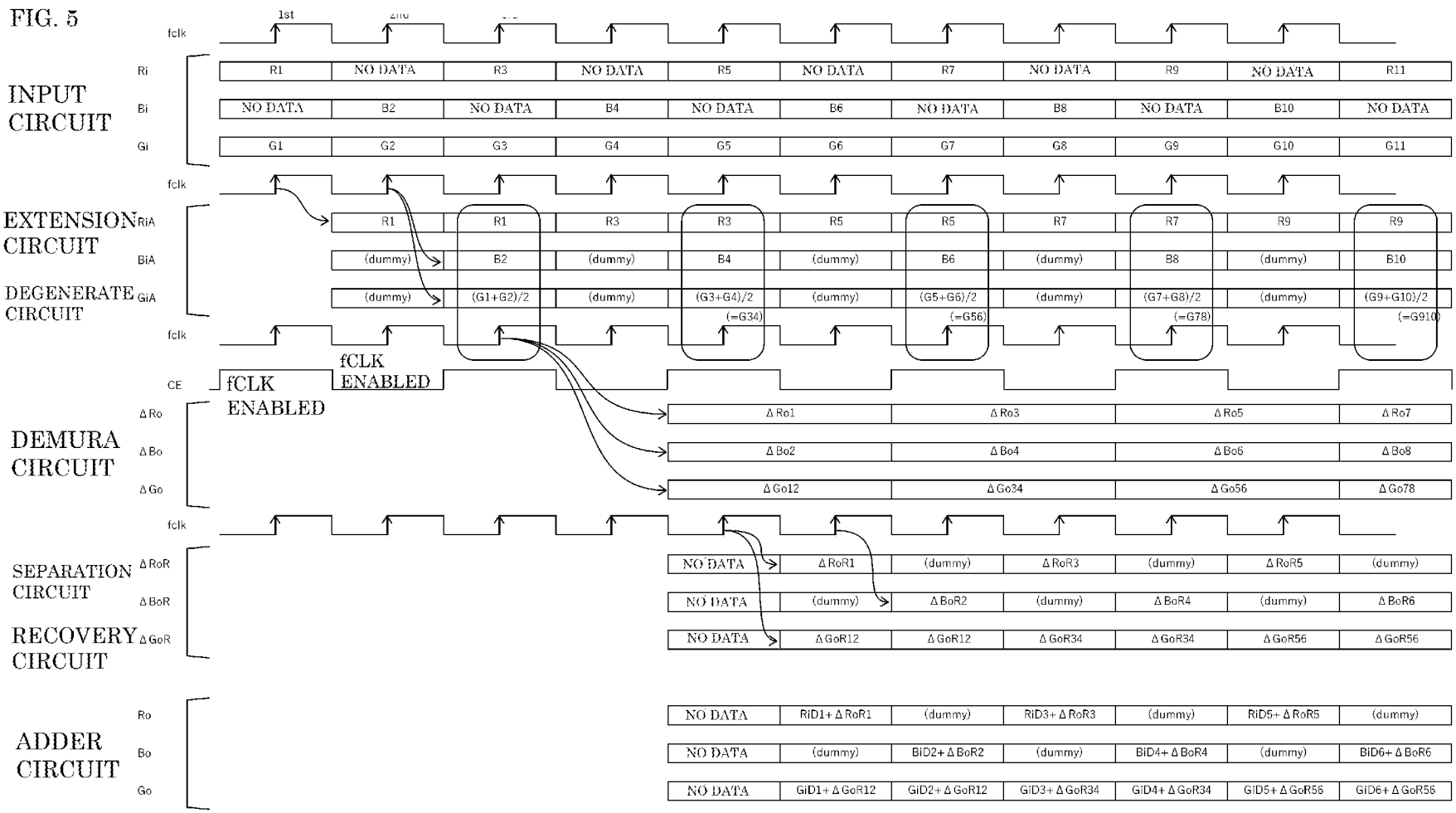
FIG. 5
INPUT CIRCUIT
EXTENSION CIRCUIT
DEGENERATE CIRCUIT
DEMURA CIRCUIT
SEPARATION CIRCUIT
RECOVERY CIRCUIT
ADDER CIRCUIT
fclk
Ri
Bi
Gi
RiA
BiA
GiA
CE
ΔRo
ΔBo
ΔGo
ΔRoR
ΔBoR
ΔGoR
Ro
Bo
Go
1st
2nd
fCLK ENABLED
NO DATA
(dummy)
(=G34)
(=G56)
(=G78)
(=G910)
ΔRo1
ΔRo3
ΔRo5
ΔRo7
ΔBo2
ΔBo4
ΔBo6
ΔBo8
ΔGo12
ΔGo34
ΔGo56
ΔGo78
ΔRoR1
ΔRoR3
ΔRoR5
ΔBoR2
ΔBoR4
ΔBoR6
ΔGoR12
ΔGoR34
ΔGoR56
RiD1+ΔRoR1
RiD3+ΔRoR3
RiD5+ΔRoR5
BiD2+ΔBoR2
BiD4+ΔBoR4
BiD6+ΔBoR6
GiD1+ΔGoR12
GiD3+ΔGoR34
GiD5+ΔGoR56
GiD2+ΔGoR12
GiD4+ΔGoR34
GiD6+ΔGoR56

PRIOR ART

PRIOR ART

INPUT SIGNAL CORRECTION DEVICE

TECHNICAL FIELD

The present invention relates to an input signal correction device for correcting input signals with respect to a display panel having uneven numbers of R, G and B subpixels.

BACKGROUND ART

Conventionally, as described in Patent Document 1, LCD, OLED, micro LED and other display panels having uneven numbers of R, G and B subpixels, also called a PenTile (registered trademark) structure, are known. Display panels having such a structure are able to secure a resolution with a small number of subpixels, and have recently been widely employed in smartphone displays and other devices.

As shown in FIG. 6, in a display panel 1 having an RGBG pixel structure, a 1st pixel $P_1$ includes an R subpixel $P_{1R}$ and a G subpixel $P_{1G}$, a 2nd pixel $P_2$ includes a B subpixel $P_{2B}$ and a G subpixel $P_{2G}$, a (2k+1)th pixel $P_{(2k+1)}$ (where k is an integer greater than or equal to 1) includes an R subpixel $P_{(2k+1)R}$ and a G subpixel $P_{(2k+1)G}$, and a (2k+2)th pixel $P_{(2k+2)}$ includes an B subpixel $P_{(2k+2)B}$ and a G subpixel $P_{(2k+2)G}$. This display panel 1 may have an input signal correction device 2 such as shown in FIG. 7, so that even if the panel body is structurally susceptible to mura (clouding), input image signals are corrected with software to eliminate mura (demura process) before being output to the panel body.

The input signal correction device 2 includes an input circuit 3 configured to operate at an operating frequency f and to receive input of R, G and B input signals (image signals), an extension circuit 4 configured to operate at the operating frequency f and to extend the period of an input signal Ri relating to R subpixels and an input signal Bi relating to B subpixels, out of the R, G and B input signals input to the input circuit 3, by a factor of 2 and output preprocessing signals RiA and BiA, a delay circuit 5 configured to operate at the operating frequency f and to delay an input signal Gi relating to G subpixels, out of the R, G and B input signals input to the input circuit 3, and output a preprocessing signal GiA at substantially the same time as output of the preprocessing signals RiA and BiA by the extension circuit 4, a demura circuit 6 configured to operate at the operating frequency f and to correct the preprocessing signals RIA, BiA and GIA and output correction signals ΔRo, ΔBo and ΔGo, a delay adjustment circuit 7 configured to operate at the operating frequency f and to delay the input signals Ri, Bi and Gi and output delay signals RiD, BiD and GiD, an adder circuit 8 configured to add the correction signals ΔRo, ΔBo and ΔGo to the delay signals RiD, BiD and GiD and output output signals Ro, Bo and Go (Ro=RiD+ΔRo, Bo=BiD+ΔBo, Go=GiD+ΔGo), and a clock circuit 9 configured to generate a clock signal of operating frequency f to be input to the input circuit 3, the extension circuit 4, the delay circuit 5, the demura circuit 6 and the delay adjustment circuit 7. As described in Patent Document 2, mura of the panel body is corrected by inputting the output signals Ro, Bo and Go to the panel body, rather than directly inputting the input signals Ri, Bi and Gi.

CITATION LIST

Patent Document

Patent Document 1: JP4647213
Patent Document 2: JP6220674

SUMMARY OF INVENTION

Technical Problem

Incidentally, in the past, the mura correction performance of the input signal correction device was important for technical competitiveness, but with the marked improvements in display panel performance in recent years, reduction in power consumption is now becoming the differentiating point. In particular, increases in the screen size and processor speed of mobile devices such as smartphones has meant that batteries are more easily drained, and reduction in power consumption relating to display panels has become an issue.

The present invention has been made in view of the above circumstances, and an object thereof is to provide an input signal correction device capable of reducing power consumption.

Solution to Problem

In order to solve the above problem, the invention is an input signal correction device for correcting input signals with respect to a display panel in which numbers of R, G and B subpixels are uneven at a ratio of minority subpixels to majority subpixels of 1:N, where N is an integer of 2 or more, including an input circuit configured to operate at an operating frequency f and to receive input of R, G and B input signals, an extension circuit configured to operate at the operating frequency f and to extend a period of a first input signal relating to the minority subpixels, out of the R, G and B input signals input to the input circuit, by a factor of N and output a first preprocessing signal, a degenerate circuit configured to operate at the operating frequency f and to degenerate a second input signal relating to the majority subpixels, out of the R, G and B input signals input to the input circuit, to 1/N and output a second preprocessing signal at substantially the same time as the first preprocessing signal, a correction circuit configured to operate at an operating frequency f/N and to correct the first preprocessing signal and output a first correction signal and also correct the second preprocessing signal and output a second correction signal, a separation circuit configured to operate at the operating frequency f and to reduce a period of the first correction signal to 1/N and output a first differential signal, a recovery circuit configured to operate at the operating frequency f and to reduce a period of the second correction signal to 1/N and output the same second differential signal over N periods, a delay adjustment circuit configured to operate at the operating frequency f and to delay the first input signal and output a first delay signal and also delay the second input signal and output a second delay signal, and an adder circuit configured to add the first differential signal to the first delay signal and also add the second differential signal to the second delay signal.

This input signal correction device may include a clock circuit configured to generate a clock signal of operating frequency f to be input to the input circuit, the extension circuit, the degenerate circuit, the separation circuit, the recovery circuit and the delay adjustment circuit, and a frequency divider circuit configured to generate a clock signal of operating frequency f/N to be input to the correction circuit, by dividing a frequency of the clock signal of operating frequency f.

Alternatively, the invention is an input signal correction device for correcting input signals with respect to a display panel in which numbers of R, G and B subpixels are uneven at a ratio of minority subpixels to majority subpixels of 1:N, where N is an integer of 2 or more, including an input circuit configured to operate based on a clock signal of frequency f and to receive input of R, G and B input signals, an extension circuit configured to operate based on the clock signal and to extend a period of a first input signal relating to the minority subpixels, out of the R, G and B input signals input to the input circuit, by a factor of N and output a first preprocessing signal, a degenerate circuit configured to operate based on the clock signal and to degenerate a second input signal relating to the majority subpixels, out of the R, G and B input signals input to the input circuit, to 1/N and output a second preprocessing signal at substantially the same time as the first preprocessing signal, a correction circuit configured to operate based on the clock signal and receive input of a clock enable signal for switching the clock signal between enabled and disabled at a frequency f/N, and to correct the first preprocessing signal and output a first correction signal and also correct the second preprocessing signal and output a second correction signal, a separation circuit configured to operate based on the clock signal and to reduce a period of the first correction signal to 1/N and output a first differential signal, a recovery circuit configured to operate based on the clock signal and to reduce a period of the second correction signal to 1/N and output the same second differential signal over N periods, a delay adjustment circuit configured to operate based on the clock signal and to delay the first input signal and output a first delay signal and also delay the second input signal and output a second delay signal, and an adder circuit configured to add the first differential signal to the first delay signal and also add the second differential signal to the second delay signal.

This input signal correction device may include a clock circuit configured to generate the clock signal, and a clock enable circuit configured to generate the clock enable signal based on the clock signal.

Furthermore, the correction circuit may correct the first preprocessing signal to reduce mura of the display panel and output the first correction signal, and correct the second preprocessing signal to reduce mura of the display panel and output the second correction signal.

Advantageous Effects of Invention

According to an input signal correction device of the present invention, power consumption can be reduced.

BRIEF DESCRIPTION OF DRAWINGS

FIG. 5 is an illustrative diagram showing outputs of an input circuit, an extension circuit, a degenerate circuit, a demura circuit, a separation circuit, a recovery circuit and an adder circuit of the input signal correction device in FIG. 4.

DESCRIPTION OF EMBODIMENTS

Embodiments of the invention will be described using the drawings.

Figure 1:
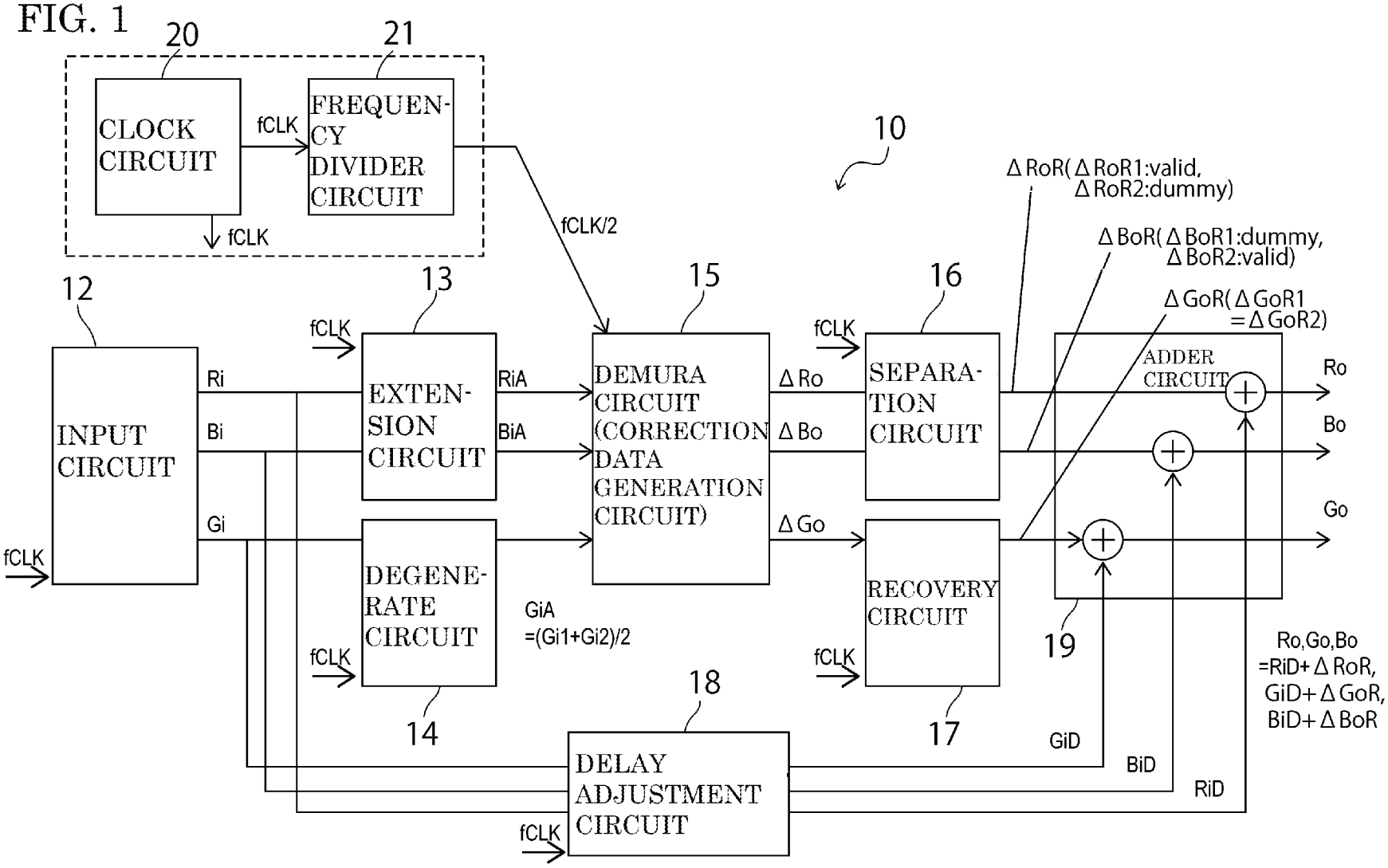
FIG. 1 is a block diagram showing an input signal correction device according to an embodiment of the invention.
Figure 2:
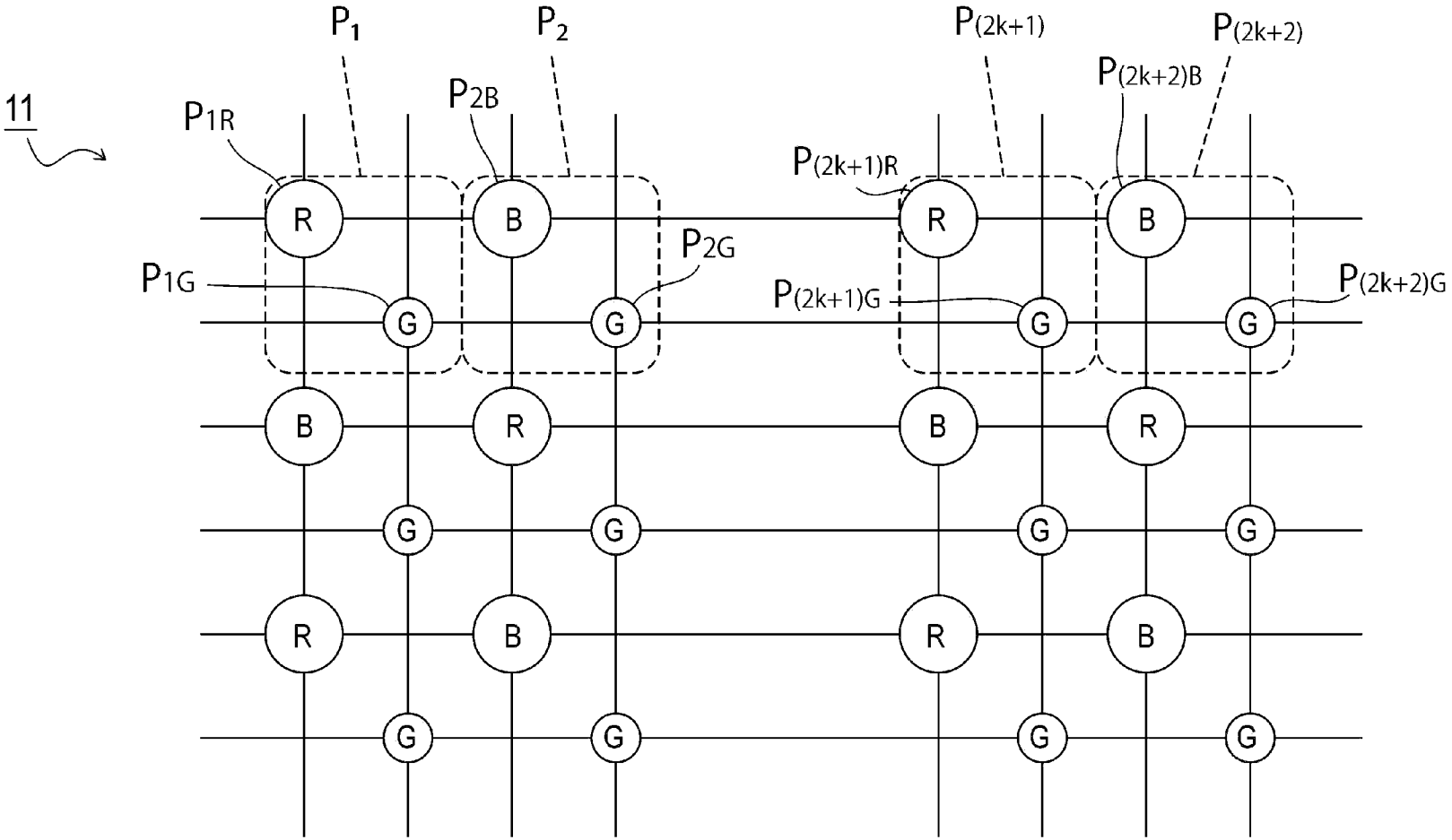
FIG. 2 is an illustrative diagram showing a panel body of a display panel to which the input signal correction device of FIG. 1 is applied.

FIG. 1 shows an input signal correction device according to the present embodiment. This input signal correction device 10 superposes a signal obtained by inverting the polarity of a mura signal acquired in advance on an input image signal and cancels mura of the panel body in a display panel 11 shown in FIG. 2 having an RGBG pixel structure similarly to the display panel 1.

In the panel body of the display panel 11, pixels consisting of an R subpixel and a G subpixel and pixels consisting of a B subpixel and a G subpixel are alternately arrayed horizontally and vertically. Specifically, a 1st pixel $P_1$ includes an R subpixel $P_{1R}$ and a G subpixel $P_{1G}$, a 2nd pixel $P_2$ includes a B subpixel $P_{2B}$ and a G subpixel $P_{2G}$, a (2k+1)th pixel $P_{(2k+1)}$ includes an R subpixel $P_{(2k+1)R}$ and a G subpixel $P_{(2k+1)G}$, and a (2k+2)th pixel $P_{(2k+2)}$ includes a B subpixel $P_{(2k+2)B}$ and a G subpixel $P_{(2k+2)G}$.

Also, the input signal correction device 10 includes an input circuit 12, an extension circuit 13, a degenerate circuit 14, a demura circuit 15, a separation circuit 16, a recovery circuit 17, a delay adjustment circuit 18, an adder circuit 19, a clock circuit 20 and a frequency divider circuit 21.

The input circuit 12 is configured to operate at an operating frequency f and to receive input of R, G and B input signals (image signals) and output input signals to the extension circuit 13.

The extension circuit 13 is configured to operate at the operating frequency f and to extend an input signal Ri relating to R subpixels and an input signal Bi relating to B subpixels, out of the input signals of R, G and B input signals input to the input circuit 12, by a factor of 2 and output preprocessing signals RiA and BiA.

Figure 3:
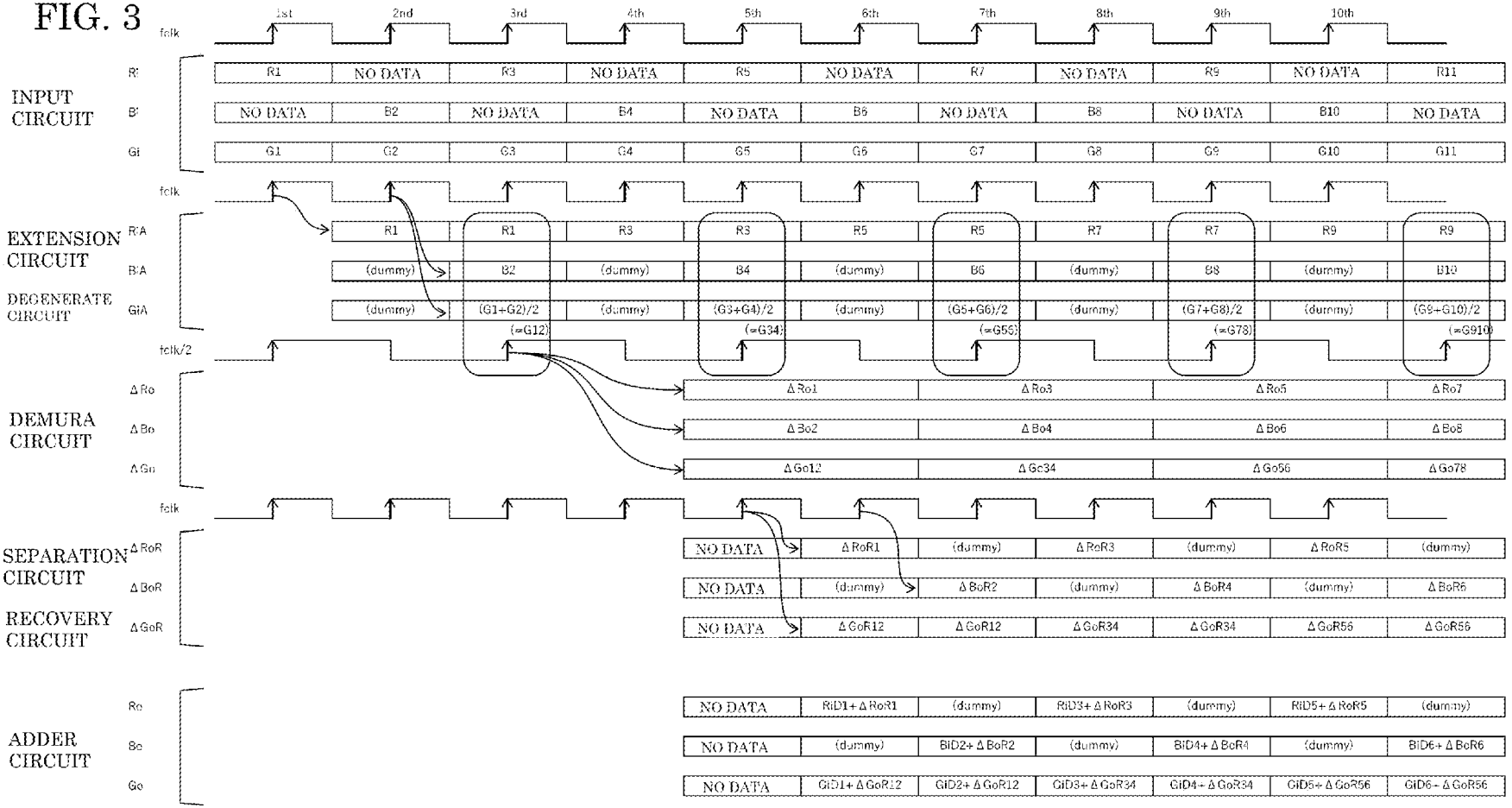
FIG. 3 is an illustrative diagram showing outputs of an input circuit, an extension circuit, a degenerate circuit, a demura circuit, a separation circuit, a recovery circuit and an adder circuit of the input signal correction device in FIG. 1.

That is, as shown in FIG. 3, a signal R1 relating to the R subpixel $P_{1R}$ of the 1st pixel $P_1$, for example, is input in the first period to the extension circuit 13 and a signal relating to an R subpixel of the 2nd pixel $P_2$ does not exist and is thus not input in the second period, and, in the extension circuit 13, a preprocessing signal RiA obtained by extending the signal R1 of the first period to the second period is generated.

Also, a signal B2 relating to the B subpixel $P_{2B}$ of the 2nd pixel $P_2$ is input in the second period to the extension circuit 13, and, in the extension circuit 13, a preprocessing signal BiA obtained by adding a dummy signal having no data in the first period to the signal B2 is generated.

The degenerate circuit 14 is configured to operate at the operating frequency f and to degenerate an input signal Gi relating to G subpixels, out of the R, G and B input signals input to the input circuit 12, and output a preprocessing signal GiA at substantially the same time as output of the preprocessing signals RiA and BiA by the extension circuit 13. Here, "degenerate" involves converting data of X pixels into data of Y pixels (Y<X) by deriving an arithmetic mean value, a weighted mean value, a central value or the like. A signal G1 relating to the G subpixel $P_{1G}$ of the 1st pixel $P_1$ is input in the first period and a signal G2 relating to the G subpixel $P_{2G}$ of the 2nd pixel $P_2$ is input in the second period to the degenerate circuit 14, and, in the degenerate circuit 14, a preprocessing signal GiA obtained by assigning a signal (G1+G2)/2 obtained by taking the arithmetic mean of the signal G1 and the signal G2 to the second period and adding a dummy signal in the first period is generated.

The demura circuit 15 is configured to operate at an operating frequency f/2 and to correct the preprocessing signals RiA, BiA and GiA and output correction signals ΔRo, ΔBo and ΔGo. That is, the signals R1, B2 and (G1+G2)/2, which are the preprocessing signals RiA, BiA and GiA of the second period, are input to the demura circuit 15, and, in the demura circuit 15, signals ΔRo1, ΔBo2 and ΔGo12 are generated as the correction signals ΔRo, ΔBo and ΔGo, by correcting the signals R1, B2 and (G1+G2)/2 based on correction data stored in the demura circuit 15. At this time, the operating frequency of the demura circuit 15 is f/2, and thus the signal lengths of the correction signals ΔRo1, ΔBo2, and ΔGo12 will be doubled (two periods worth).

The separation circuit 16 is configured to operate at the operating frequency f and to reduce the period of the correction signals ΔRo and ΔBo to ½ and output differential signals ΔRoR and ΔBoR. That is, the signal ΔRo1 is input as the correction signal ΔRo in the first period and the signal ΔBo2 is input as the correction signal ΔBo in the second period to the separation circuit 16, and, in the separation circuit 16, a signal ΔRoR1 obtained by adding a dummy signal in the second period to the signal ΔRo1 and separating the signal ΔRo1 in the first period is generated, and a signal ΔBoR2 obtained by adding a dummy signal in the first period to the signal ΔBo2 and separating the signal ΔBo2 in the second period is generated.

The recovery circuit 17 is configured to operate at the operating frequency f and to reduce the period of the correction signal ΔGo to ½ and output the same differential signal ΔGoR over two periods. That is, the signal ΔGo12 is input as the correction signal ΔGo in the first period to the recovery circuit 17, and, in the recovery circuit 17, the signal ΔGo12 is also copied to the second period and recovered in the second period similarly to the input signal Gi (signal relating to G subpixel $P_{1G}$ of 1st pixel $P_1$ and signal relating to G subpixel $P_{2G}$ of 2nd pixel $P_2$), and a signal ΔGoR12 is generated.

The delay adjustment circuit 18 is configured to operate at the operating frequency f and to delay the input signals Ri, Bi and Gi and output delay signals RiD, BiD and GiD, and, in the delay adjustment circuit 18, when input of the signals R1, B1, and G1 is received, signals RiD1, BiD1 and GiD1 obtained by delaying the signals R1, B1 and G1 are generated.

The adder circuit 19 is configured to add the differential signals ΔRoR, ΔBoR and ΔGoR to the delay signals RiD, BiD and GiD and output output signals Ro, Bo and Go (Ro=RiD+ΔRoR, Bo=BiD+ΔBoR, Go=GiD+ΔGoR; note that differential signals ΔRoR, ΔBoR and ΔGoR may be positive or may be negative), and, in the adder circuit 19, the signal ΔRo1 is added to the signal RiD1 and a signal Ro1 is generated, the signal ΔBo2 is added to the signal BiD2 and a signal Bo2 is generated, the signal ΔGo12 is added to the signal GiD1 and a signal Go1 is generated, and the signal ΔGo12 is added to a signal GiD2 and the signal Go1 is generated.

The clock circuit 20 generates a clock signal of operating frequency f to be input to the input circuit 12, the extension circuit 13, the degenerate circuit 14, the separation circuit 16, the recovery circuit 17 and the delay adjustment circuit 18, and the frequency divider circuit 21 generate a clock signal of operating frequency f/2 to be input to the demura circuit 15, by dividing the frequency of the clock signal of operating frequency f by 2.

The input signal correction device 10 according to the present embodiment includes the input circuit 12 configured to operate at the operating frequency f and to receive input of R, G and B input signals, the extension circuit 13 configured to operate at the operating frequency f and to extend the period of the input signal Ri relating to R subpixels and the input signal Bi relating to B subpixels, out of the R, G and B input signals input to the input circuit 12, by a factor of 2 and output the preprocessing signals RiA and BiA, the degenerate circuit 14 configured to operate at the operating frequency f and to degenerate (here, calculate the mean of) the input signal Gi relating to G subpixels, out of the R, G and B input signals input to the input circuit 2, and output the preprocessing signal GiA at substantially the same time as the preprocessing signals RiA and BiA that are output by the extension circuit 13, the demura circuit 15 configured to operate at the operating frequency f/2 and to correct the preprocessing signals RiA, BiA and GiA and output the correction signals ΔRo, ΔBo and ΔGo, the separation circuit 16 configured to operate at the operating frequency f and to reduce the period of the correction signals ΔRo and ΔBo to ½ and output the differential signals ΔRoR and ΔBoR, the recovery circuit 17 configured to operate at the operating frequency f and to reduce the period of the correction signal ΔGo to ½ and output the same differential signal ΔGo over two periods, the delay adjustment circuit 18 configured to operate at the operating frequency f and to delay the input signals Ri, Bi and Gi and output the delay signals RiD, BiD and GiD, and the adder circuit 19 configured to add the differential signals ΔRoR, ΔBoR and ΔGoR to the delay signals RiD, BiD and GiD and output the output signals Ro, Bo and Go. Accordingly, the operating frequency of the demura circuit 15 can be lowered to ½, by degenerating the input signal Gi to ½ with the degenerate circuit 14, and thus the power consumption required for demura (mura correction) can be reduced by substantially half.

Figure 4:
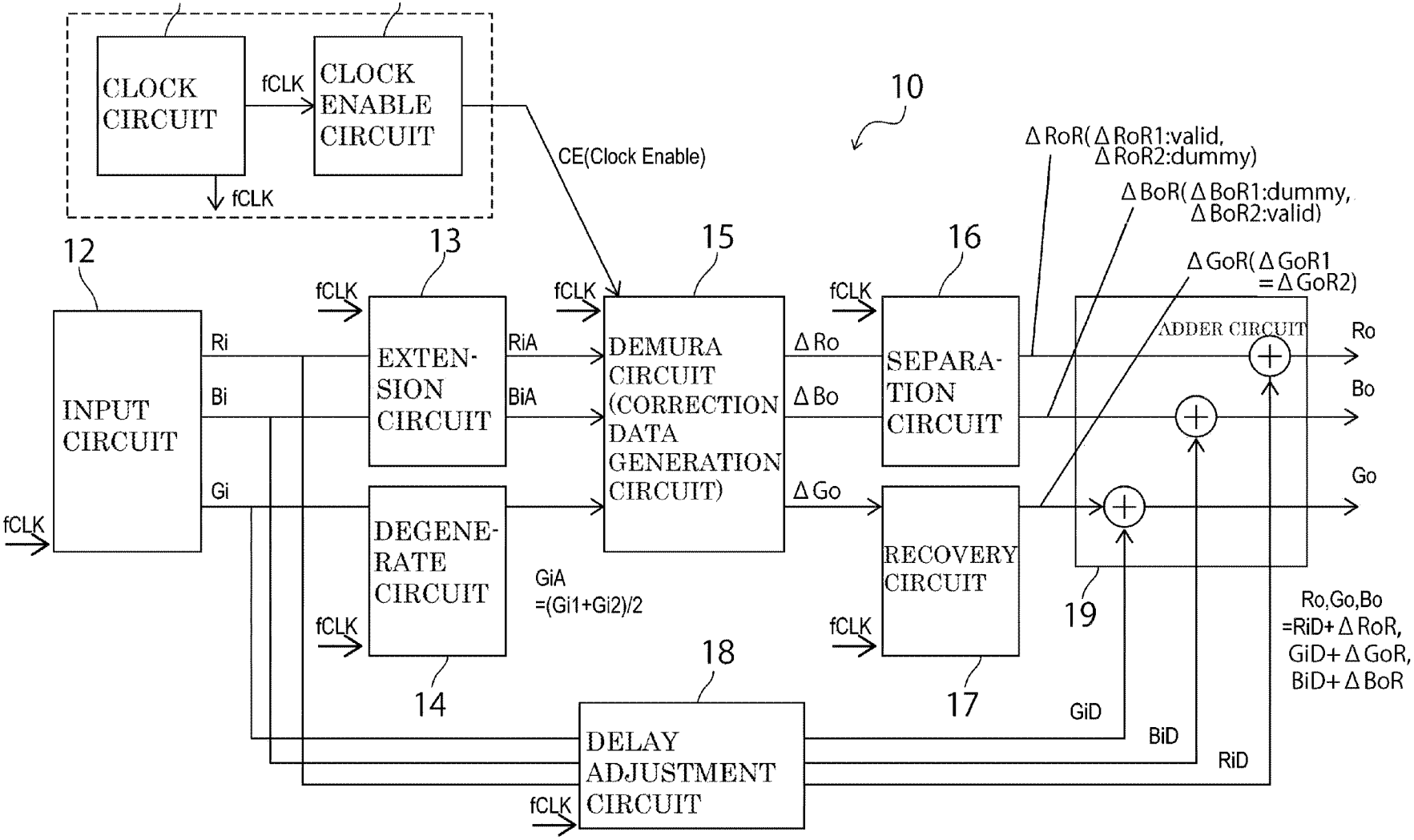
FIG. 4 is a block diagram showing another input signal correction device according to an embodiment of the invention.
Figure 6:
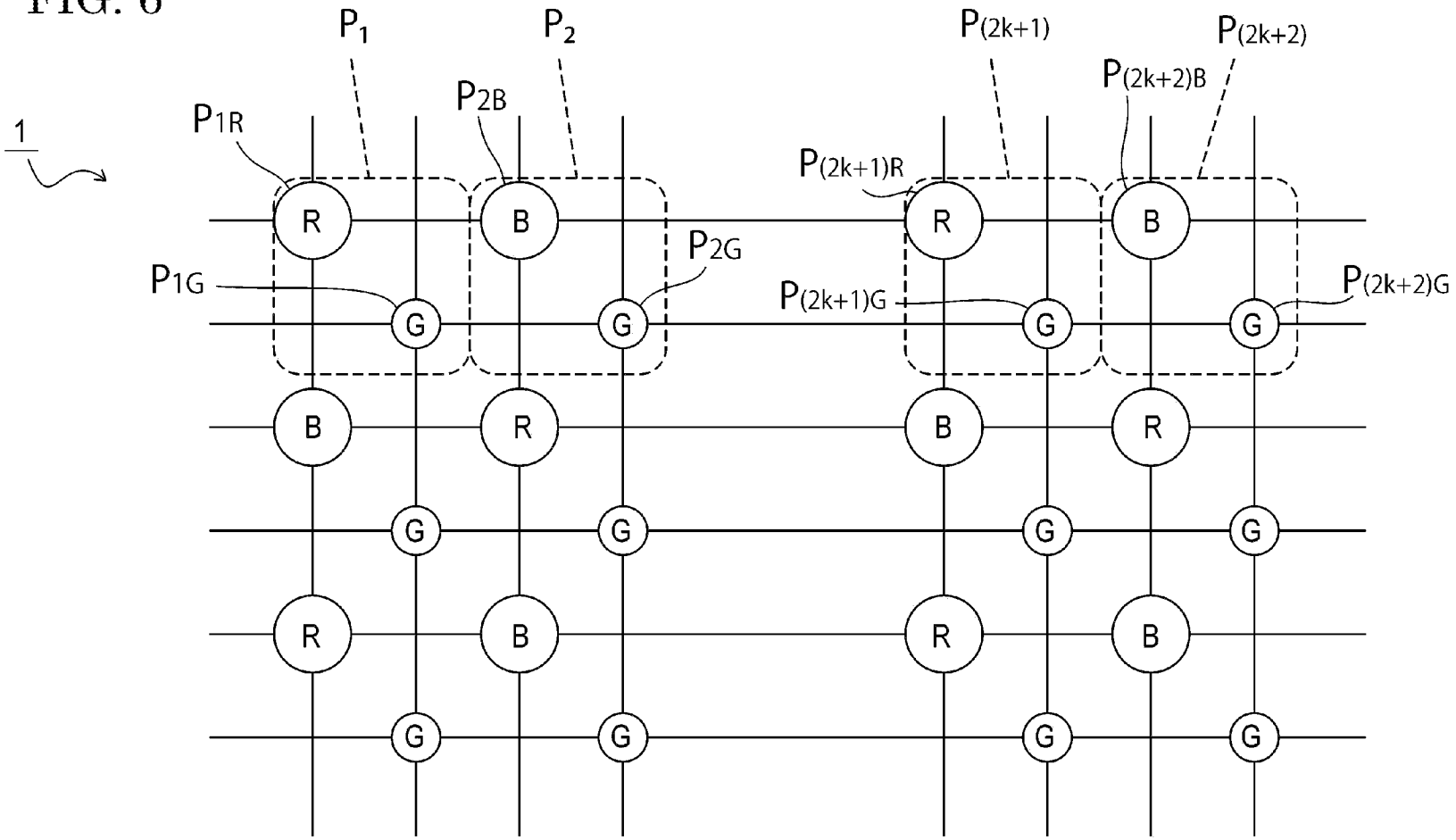
FIG. 6 is an illustrative diagram showing a panel body of a display panel having an RGBG pixel structure.
Figure 7:
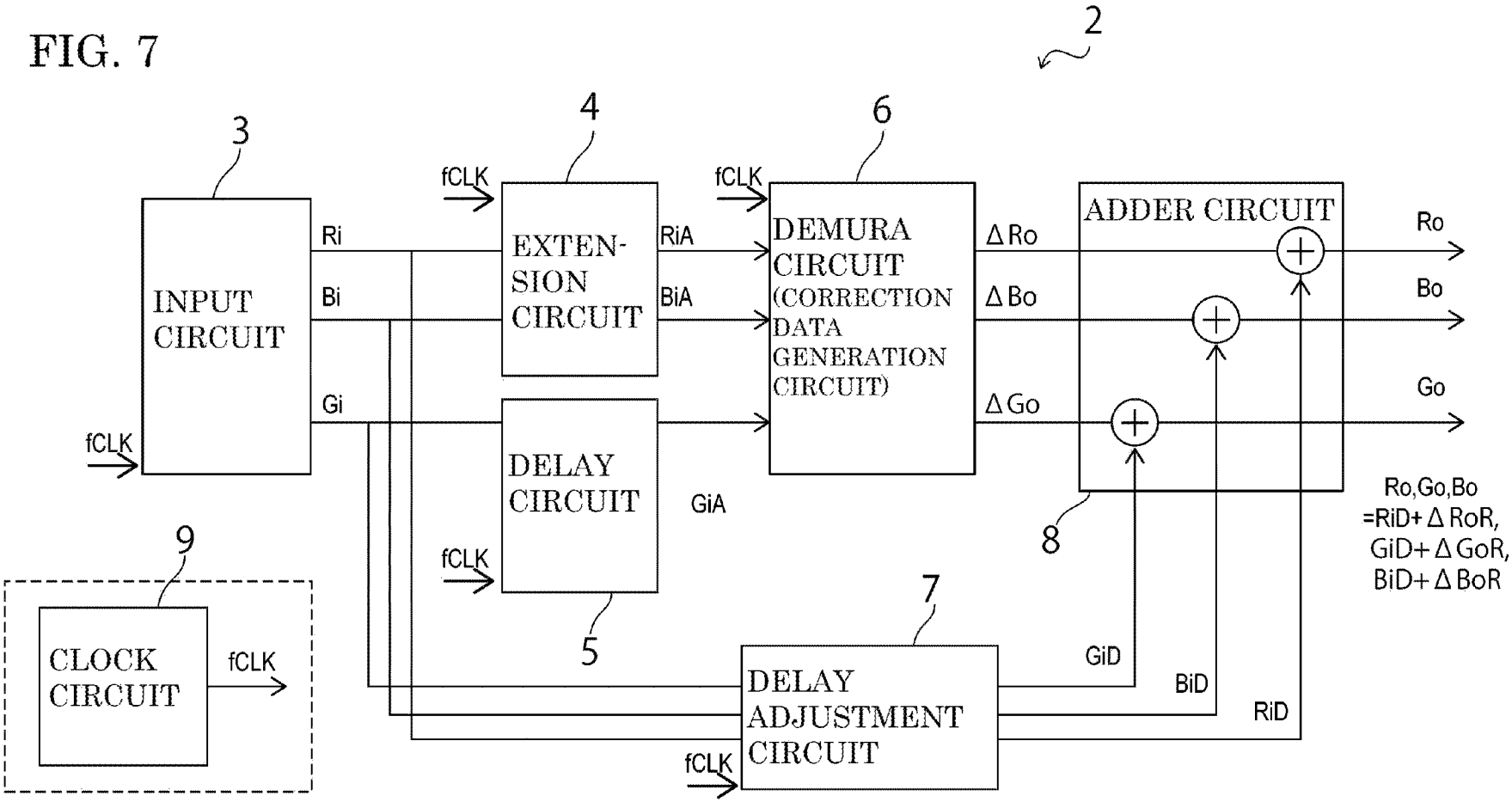
FIG. 7 is a block diagram showing a conventional input signal correction device.

FIG. 4 shows another input signal correction device according to the present embodiment. This input signal correction device 30 superposes a signal obtained by inverting the polarity of a mura signal acquired in advance on an input image signal and cancels mura of the panel body in the display panel 11, and, apart from the operation of the demura circuit 15 being different from the input signal correction device 10 and a clock enable circuit 31 being provided instead of the frequency divider circuit 21, has a similar configuration to the input signal correction device 10.

In the input signal correction device 30, the clock enable circuit 31 generates a clock enable signal for switching between enabling and disabling the clock signal at a frequency f/N, based on the clock signal of frequency f generated by the clock circuit 20, and outputs this clock enable signal to the demura circuit 15.

As shown in FIG. 5, the demura circuit 15 operates based on the clock signal of frequency f generated by the clock circuit 20, and receives input of the clock enable signal generated by the clock enable circuit 31, and, in the demura circuit 15, similarly to the case of the input signal correction device 10, the signals R1, B2 and (G1+G2)/2, which are the preprocessing signals RiA, BiA and GIA of the second period, are input at the timing at which the clock enable signal is High (at this time, the clock signal is enabled, and when the clock enable signal is Low, the clock signal is disabled). In the demura circuit 15, the signals ΔRo1, ΔBo2 and ΔGo12 are generated as the correction signals ΔRo, ΔBo and ΔGo, by correcting the signals R1, B2 and (G1+G2)/2 based on correction data stored in the demura circuit 15.

This input signal correction device 30 includes the input circuit 12 configured to operate based on the clock signal of operating frequency f and to receive input of R, G and B input signals, the extension circuit 13 configured to operate based on the clock signal of operating frequency f and to extend the period of the input signal Ri relating to R subpixels and the input signal Bi relating to B subpixels, out of the R, G and B input signals input to the input circuit 12, by a factor of 2 and output the preprocessing signals RIA and BiA, the degenerate circuit 14 configured to operate based on the clock signal of operating frequency f and to degenerate the input signal Gi relating to G subpixels, out of the R, G and B input signals input to the input circuit 2, and output the preprocessing signal GIA at substantially the same time as the preprocessing signals RiA and BiA that are output by the extension circuit 13, the demura circuit 15 configured to operate based on the clock signal of frequency f and receive input of the clock enable signal for switching the clock signal between enabled and disabled at the frequency f/2, and to correct the preprocessing signals RiA, BiA and GiA and output the correction signals ΔRo, ΔBo and ΔGo, the separation circuit 16 configured to operate based on the clock signal of frequency f and to reduce the period of the correction signals ΔRo and ΔBo to ½ and output the differential signals ΔRoR and ΔBoR, the recovery circuit 17 configured to operate based on the clock signal of frequency f and to reduce the period of the correction signal ΔGo to ½ and output the same differential signal ΔGo over two periods, the delay adjustment circuit 18 configured to operate based on the clock signal of frequency f and to delay the input signals Ri, Bi and Gi and output the delay signals RiD, BiD and GiD, and the adder circuit 19 configured to add the differential signals ΔRoR, ΔBoR and ΔGoR to the delay signals RiD, BiD and GiD and output the output signals Ro, Bo and Go. Accordingly, the demura circuit 15 can be operated in an equivalent manner to the input signal correction device 10, by degenerating the input signal G to ½ with the degenerate circuit 14 and inputting the clock enable signal to the demura circuit 15, and power consumption required for demura can be reduced.

Although embodiments of the present invention are illustrated above, the embodiments of the invention are not limited to those described above, and changes and the like can be made as appropriate without departing from the spirit of the invention.

For example, the panel body of the display panel to which the input signal correction device is applied is not limited to a panel body having an RGBG pixel structure, and may have an RBGB pixel structure in which pixels including an R subpixel and a B subpixel and pixels including a G subpixel and a B subpixel are combined, or may have an RBRG pixel structure in which pixels including a G subpixel and an R subpixel and pixels including a G subpixel and an R subpixel are combined.

Also, the numbers of R, G and B subpixels do not necessarily need to satisfy a ratio of minority subpixels to majority subpixels of 1:2, and may, for example, be a ratio of minority subpixels to majority subpixels of 1:3, such that the signal of the majority subpixels is degenerated to ⅓ rather than ½ by the degenerate circuit, and the frequency divider circuit is a ⅓ frequency divider circuit rather than a ½ frequency divider circuit.

Furthermore, the correction of input signals is not limited to mura correction, and the input signal correction device according to the present invention may perform any manner of correction.

LIST OF REFERENCE NUMERALS

10 Input signal correction device
11 Display panel
12 Input circuit
13 Extension circuit
14 Degenerate circuit
15 Demura circuit (correction circuit)
16 Separation circuit
17 Recovery circuit
18 Delay adjustment circuit
19 Adder circuit
20 Clock circuit
21 Frequency divider circuit
30 Input signal correction device
31 Clock enable circuit

The invention claimed is:

1. An input signal correction device for correcting input signals with respect to a display panel in which numbers of R, G and B subpixels are uneven at a ratio of minority subpixels to majority subpixels of 1:N, where N is an integer of 2 or more, comprising:

an input circuit configured to operate at an operating frequency f and to receive input of R, G and B input signals;

an extension circuit configured to operate at the operating frequency f and to extend a period of a first input signal relating to the minority subpixels, out of the R, G and B input signals input to the input circuit, by a factor of N and output a first preprocessing signal;

a degenerate circuit configured to operate at the operating frequency f and to degenerate a second input signal relating to the majority subpixels, out of the R, G and B input signals input to the input circuit, to 1/N and output a second preprocessing signal at substantially the same time as the first preprocessing signal;

a correction circuit configured to operate at an operating frequency f/N and to correct the first preprocessing signal and output a first correction signal and also correct the second preprocessing signal and output a second correction signal;

a separation circuit configured to operate at the operating frequency f and to reduce a period of the first correction signal to 1/N and output a first differential signal;

a recovery circuit configured to operate at the operating frequency f and to reduce a period of the second correction signal to 1/N and output the same second differential signal over N periods;

a delay adjustment circuit configured to operate at the operating frequency f and to delay the first input signal and output a first delay signal and also delay the second input signal and output a second delay signal; and an adder circuit configured to add the first differential signal to the first delay signal and also add the second differential signal to the second delay signal.

2. The input signal correction device according to claim 1, comprising:

a clock circuit configured to generate a clock signal of operating frequency f to be input to the input circuit, the extension circuit, the degenerate circuit, the separation circuit, the recovery circuit and the delay adjustment circuit; and a frequency divider circuit configured to generate a clock signal of operating frequency f/N to be input to the correction circuit, by dividing a frequency of the clock signal of operating frequency f.

3. The input signal correction device according to claim 2, wherein the correction circuit corrects the first preprocessing signal to reduce mura of the display panel and outputs the first correction signal, and corrects the second preprocessing signal to reduce mura of the display panel and outputs the second correction signal.

4. The input signal correction device according to claim 1, wherein the correction circuit corrects the first preprocessing signal to reduce mura of the display panel and outputs the first correction signal, and corrects the second preprocessing signal to reduce mura of the display panel and outputs the second correction signal.

5. An input signal correction device for correcting input signals with respect to a display panel in which numbers of R, G and B subpixels are uneven at a ratio of minority subpixels to majority subpixels of 1:N, where N is an integer of 2 or more, comprising:

an input circuit configured to operate based on a clock signal of frequency f and to receive input of R, G and B input signals;

an extension circuit configured to operate based on the clock signal and to extend a period of a first input signal relating to the minority subpixels, out of the R, G and B input signals input to the input circuit, by a factor of N and output a first preprocessing signal;

a degenerate circuit configured to operate based on the clock signal and to degenerate a second input signal relating to the majority subpixels, out of the R, G and B input signals input to the input circuit, to 1/N and output a second preprocessing signal at substantially the same time as the first preprocessing signal;

a correction circuit configured to operate based on the clock signal and receive input of a clock enable signal for switching the clock signal between enabled and disabled at a frequency f/N, and to correct the first preprocessing signal and output a first correction signal and also correct the second preprocessing signal and output a second correction signal;

a separation circuit configured to operate based on the clock signal and to reduce a period of the first correction signal to 1/N and output a first differential signal;

a recovery circuit configured to operate based on the clock signal and to reduce a period of the second correction signal to 1/N and output the same second differential signal over N periods;

a delay adjustment circuit configured to operate based on the clock signal and to delay the first input signal and output a first delay signal and also delay the second input signal and output a second delay signal; and an adder circuit configured to add the first differential signal to the first delay signal and also add the second differential signal to the second delay signal.

6. The input signal correction device according to claim 5, further comprising:

a clock circuit configured to generate the clock signal; and a clock enable circuit configured to generate the clock enable signal based on the clock signal.

7. The input signal correction device according to claim 6, wherein the correction circuit corrects the first preprocessing signal to reduce mura of the display panel and outputs the first correction signal, and corrects the second preprocessing signal to reduce mura of the display panel and outputs the second correction signal.

8. The input signal correction device according to claim 5, wherein the correction circuit corrects the first preprocessing signal to reduce mura of the display panel and outputs the first correction signal, and corrects the second preprocessing signal to reduce mura of the display panel and outputs the second correction signal.

* * * * *